United States Patent [19]

Stahlhut et al.

[11] 4,047,336

[45] Sept. 13, 1977

[54] LIGHTING SYSTEM

[75] Inventors: Leo G. Stahlhut, Kirkwood; Willard R. Garnett, Bellefontaine Neighbors, both of Mo.

[73] Assignee: Emerson Electric Co., St. Louis, Mo.

[21] Appl. No.: 622,859

[22] Filed: Oct. 16, 1975

[51] Int. Cl.[2] ..... E04F 19/00

[52] U.S. Cl. ..... 52/28; 52/484; 52/488

[58] Field of Search ..... 52/28, 484, 487, 488, 52/758 A, 665, 726, 486; 403/292, 405

[56] References Cited

U.S. PATENT DOCUMENTS

| | | | |
|---|---|---|---|
| 3,590,544 | 7/1971 | Shepherd | 52/484 X |
| 3,628,299 | 12/1971 | Nakazawa | 52/665 X |
| 3,640,557 | 2/1972 | Note, Jr. et al. | 52/726 X |
| 3,785,110 | 1/1974 | Galloway et al. | 52/484 X |
| 3,786,602 | 1/1974 | Wilkin | 52/28 |

*Primary Examiner*—Price C. Faw, Jr.

*Assistant Examiner*—Carl D. Friedman

*Attorney, Agent, or Firm*—Polster, Polster and Lucchesi

[57] ABSTRACT

A lighting system is provided having a unique main runner structural configuration that enhances the adaptability of the system to a number of uses, including one-way, corridor and grid ceiling patterns. The main runner has an inverted U-shape design in cross section, the legs of the U-shape defining an open mouth channel. The legs also have a lip associated with them. The lower leg and lip portions or formation of the inverted shape hides the division line between various color combinations used in conjunction with the main runner from observers of the ceiling system, and also creates a recess for holding and supporting a number of accessories associated with the ceiling system. The lip of the main runner provides support for any associated ceiling panels. One embodiment of a lighting fixture compatible with the lighting system disclosed hereinafter has offset end pieces which permit continuous linear luminaire pattern installation.

20 Claims, 29 Drawing Figures

LIGHTING SYSTEM

BACKGROUND OF THE INVENTION

This invention relates to ceiling systems, and in particular, to an overall lighting and ceiling system offering economies in installation and improved appearance.

The prior art reveals a number of suspension systems for providing attractive ceiling, lighting and air supply functions to an enclosed space or volume. While these prior art designs work for their intended function, in general, they are characterized by complicated structures having a multiplicity of components. Consequently, the manufacturer or an associated distributor is required to inventory a large number of parts in order to service customers properly. In addition, prior art systems generally are not convertible in that the structural components required for a grid ceiling design are different from those required for a corridor or those required for one-way systems. Non-convertability adds to the storage and record-keeping problem of inventory control. Prior art systems also have been deficient in that fixture placement in a system heretofore has controlled the number and placement of all other panels used to define the ceiling plane of the space under consideration.

The system disclosed hereinafter overcomes these prior art deficiencies by utilizng a novel main runner member which includes a lower formation defining a cavity for receiving support accessories, such as air pattern blades, utility hangers when the system is used in a one-way ceiling pattern, or for installation of partition sections, the partition sections serving as space dividers. The main runner also permits ready interconnection of air supply system air boots where the lighting system is used in air transfer applications. The main runners are interconnected along a unique hanger which permits easy installation, but effectively locks the main runners in position. Preferably, the length and width dimensions of the luminaire or fixture, terms used interchangably in this specification, are equal to the length and width dimensions of any associated accoustical ceiling panels and the fixture/panel position may be varied as needed.

One of the objects of this invention is to provide a low-cost lighting system.

Another object of this invention is to provide a lighting system utilizing a main runner structure which facilitates interlocking components of the lighting system.

Another object of this invention is to provide a lighting system having a main runner structure formed to hide from view any division line between various painted finishes of the runner structure.

Another object of this invention is to provide a lighting system having a main runner structure which has a lower formation designed to accept a variety of support accessories easily.

Other objects will be apparent to those skilled in the art in light of the following description and accompanying drawings.

SUMMARY OF THE INVENTION

In accordance with this invention, generally stated, a lighting system is provided which includes a main runner structure having an inverted U-shape in cross section. The legs of the U-shape project inwardly of the open mouth of the U-shape, and then extend outwardly of the leg ends so as to define a lip along two sides of the runner. The inward projection and lip definition enable the runner to have a variety of accessory structures attached to or supported by it, both internally of a chamber defined by the inverted U-shape, and externally along the lip. The system includes a luminaire having a housing, and end panels along at least two opposite ends of the housing. The end panels have tabs adapted to support the luminaire extending outwardly from the panels. The tabs are offset along a predetermined direction so that a plurality of luminaires may be placed longitudinally of one another. The system also includes a hanger for interconnecting successive ones of the main runners in secure, interlocking relationship. Slight modifications in main runner position and interconnection make the system adaptable to grid, one-way and corridor applications, for example. Preferably, the luminaire and associated ceiling panels used to complete the ceiling plane are of equal size, so that a wide variety of ceiling design combinations may be provided.

DESCRIPTION OF THE PREFERRED EMBODIMENT

Figure 1:
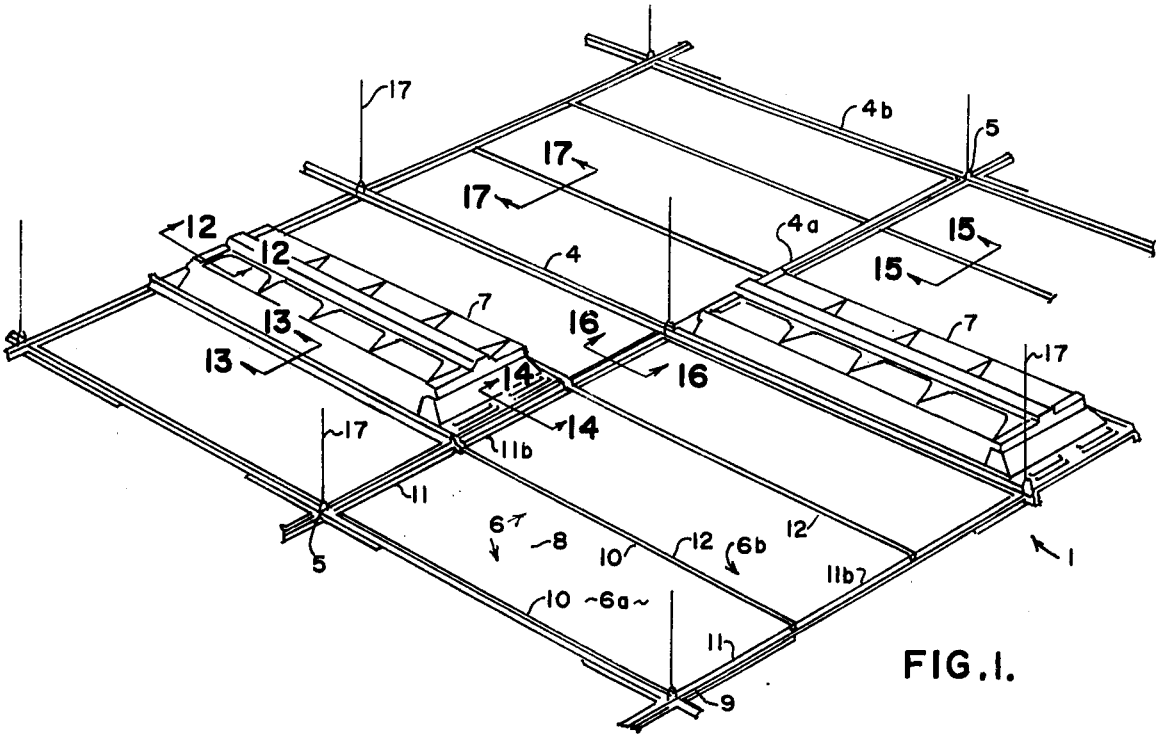
FIG. 1 is a view in perspective of one illustrative embodiment of lighting system of this invention, shown in its grid configuration.
Figure 2:
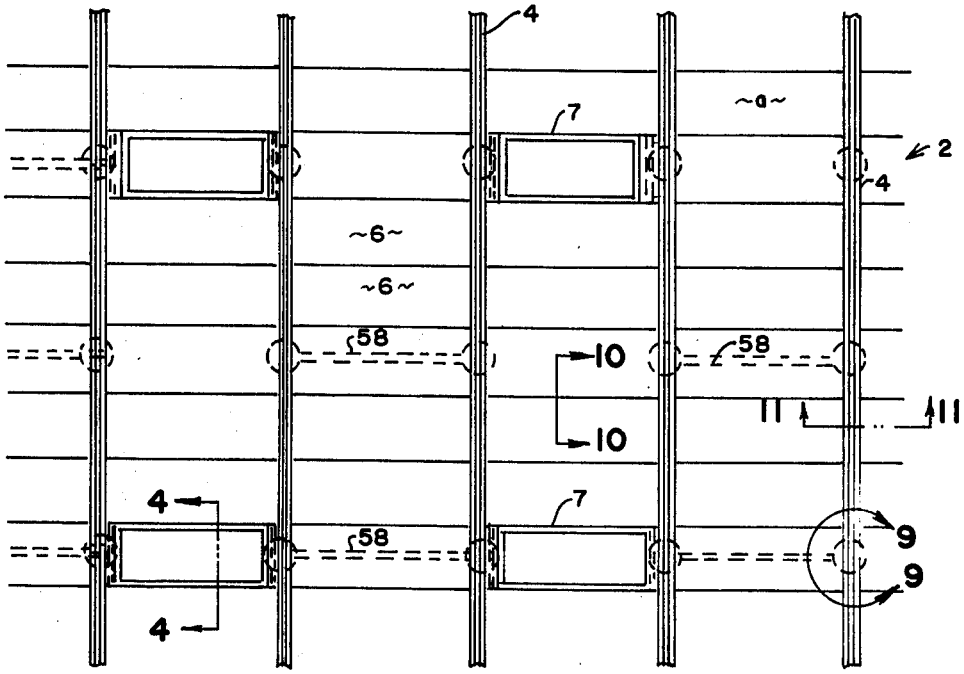
FIG. 2 is a bottom plan view of lighting system of this invention, shown in its one-way configuration.
Figure 3:
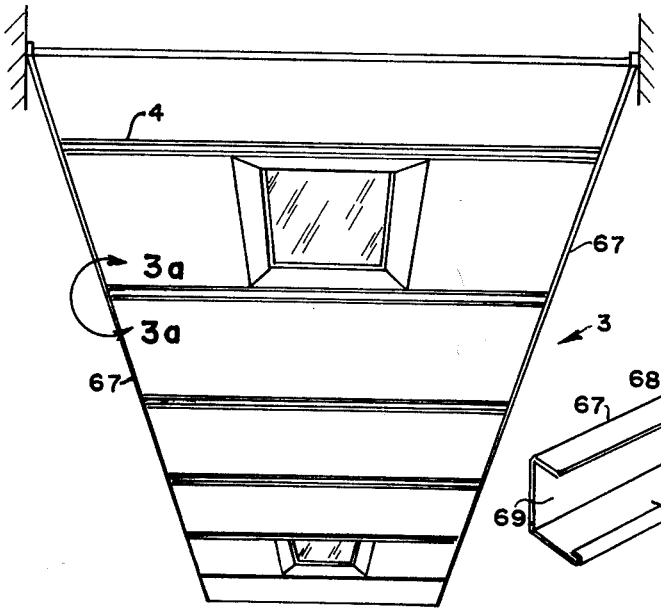
FIG. 3 is a view in perspective of an illustrative embodiment of lighting system of this invention, shown in its corridor configuration.

Referring now to FIG. 1, reference numeral 1 indicates one illustrative embodiment of lighting system of this invention. The lighting system of our invention is adaptable to a variety of applications. Those skilled in the art will recognize that the application shown in FIG. 1 is a conventional grid pattern, while that shown in FIG. 2 and indicated as a lighting system 2, represents what is known in the art as a one-way system. In a one-way system, a plurality of main runner 4 tracks are arranged parallel to one another, all of the runner tracks extending in a single direction. A variation of the one-way system 2 is used to provide a corridor system 3, shown in FIG. 3. Each of the system 1, 2 and 3 make use of the main runner 4, described in detail hereinafter. While three embodiments of lighting systems are illustrated, it will be apparent that the structural components used in constructing the various systems 1, 2 and 3 are similar to one another, and only one of the systems is described in detail, like reference numerals being used where appropriate.

The system 1 is arranged in a grid pattern in that the runners 4 cross one another at a plurality of tie points 5. In the embodiment shown, the tie points 5 are on five foot centers, and the remaining ceiling plane is defined by a combination of ceiling panels 6 and luminaires 7.

Figure 10:
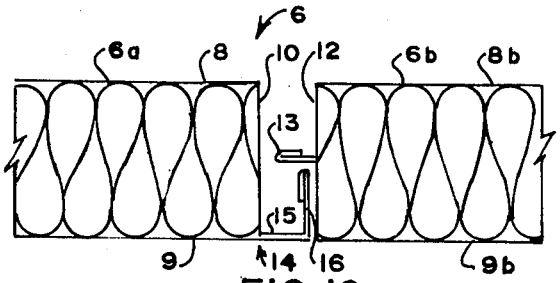
FIG. 10 is a sectional view taken along the line 10—10 of FIG. 2.
Figure 10B:
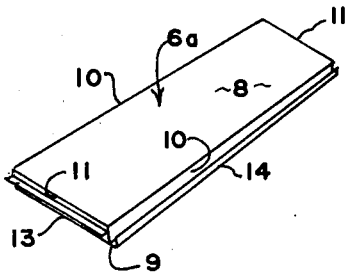
FIG. 10*b* is a view in perspective of a second illustrative embodiment of ceiling panel means compatible with the lighting system of this invention.
Figure 10A:
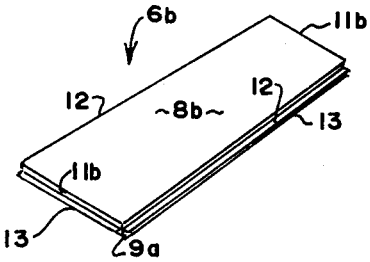
FIG. 10*a* is a view in perspective of one illustrative embodiment of ceiling panel means compatible with the lighting system of this invention.

The panels 6, shown in FIGS. 10, 10*a* and 10*b*, preferably are of two constructions, denominated by the reference numerals 6*a* and 6*b*. The panels 6*a* and 6*b* are similar to one another, except for edge features described hereinafter. The panel 6*a* has a first surface 8, a second surface 9, a first pair of oppositely opposed, longitudinal edges 10, and a second pair of oppositely opposed edges 11. The panel 6*b* also has a first surface 8*b*, a second surface 9*b*, a first pair of oppositely opposed, longitudinal edges 12, and a second pair of opposed edges 11*b*. The edges 11*b* and 11 of the panels 6*b* and 6*a*, respectively, have a tab 13 extending outwardly from them. In the panel 6*b*, the tab 13 also extends outwardly from the edges 12, so that the perimeter of the panel is defined by the tab 13. Tab 13 may be constructed by any convenient method. For example, the surfaces 8, 8*a* and 9, 9*b* may be sheet metal sections formed to define the tab 13 along the edges of the panel. The panel 6*a*, however, has an L-shaped structure 14 attached to it, along each of the edges 10. The structure 14 includes a first leg 15 projecting outwardly from the edges 10, and a leg 16 extending perpendicularly from the leg 15. The edges 11 of the panel 6*a* are similar to the edges 11*b* and 12 of the panel 6*b*. As observable in FIGS. 10 and 13, the structure 14 is adapted to receive the tab 13 of the panel 6*b*, or the edge of the luminaire 7, in the interconnection of components forming the ceiling system of this invention.

The structure 14 also may be constructed by any convenient method. Use of the material forming the surface 8 or 9 to form the structure 14 works well, for example.

Figure 5:
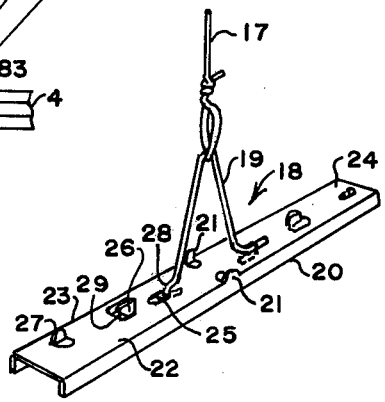
FIG. 5 is a view in perspective of a hanger means utilized in conjunction with the lighting system of this invention.
Figure 7:
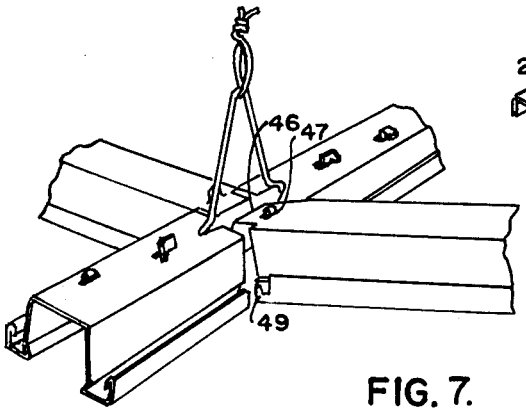
FIG. 7 is a view in perspective, partly broken away, illustrating the interconnection of four main runner members for the grid system shown in FIG. 1.

It is conventional to construct a ceiling in a building or the like by suspending a plurality of drop wires 17 from the building structure defining either the succeeding floor or the building roof. Thereafter, a hanger assembly 18 is attached to each of the drop wires 17 by any conventional expedient. The hanger assembly 18 includes a wire bail hanger 19 and a coupling 20, best observed in FIG. 5.

The interconnection of a plurality of main runners 4 in the construction of the lighting system of this invention is accomplished by the use of the coupling 20. In general, the coupling 20 has a rectangular body 22 having a pair of tabs 21 formed from it. The tabs 21 are constructed at the approximate mid-point of the longitudinal length of the body 22 so as to divide the coupling 20 into a first side 23 and a second side 24. The structural features of the sides 23 and 24 of the coupling 20 are identical, and include an elongated or oblong opening 25 through the body 22; a cut-away tab 26, and a tab 27, both of which are constructed from the body 22. The openings 25 are sized to receive the ends of the wire bail hanger 19.

The tab 26 is unusual in that an edge 29 of the tab 26 is cut away during the formation of the tab, for purposes described hereinafter. Tab 27 is conventional. As indicated, it is punched from the material thickness of the body 20.

Wire bail hanger 19 is V-shaped in plan. Each of the legs of the V-shape of the hanger 19 has a hook 28 formed in it. Hook 28 includes an outwardly projecting portion 106 and an inwardly extending arm 107, shown in phantom lines in FIG. 6. The natural resiliency of the material used in the construction of the hanger 19 tends to bias the legs toward one another, the legs being flexible enough to permit them to be separated during the insertion of the hooks 28 in the openings 25. The drop wire 17 preferably is attached to the hangers 19 along the vertex of the V-shape.

Figure 22:
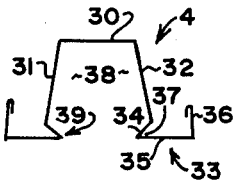
FIG. 22 is a diagrammatic end view of a main runner used in conjunction with the lighting system of this invention.

The runner 4, used in conjunction with the lighting systems of this invention, has a unique cross section, best seen in FIG. 22. As there shown, the runner 44 has a top wall or connecting portion 30 and a pair of legs 31 and 32 extending downwardly from the top 30 at an angle other than vertical, vertical being referenced to FIG. 22, giving the runner 4 an inverted U-shape appearance in cross section. While the width of the top 30 may vary, preferably, it is larger than the width of the coupling 20 so that the coupling 20 abuts the top 30 after interconnection of certain ones of the runners 4. Each of the legs 31 and 32 has a lower formation 33 attached to them, opposite the integral connection of the legs 31 and 32 with the top 33. The lower formation 33 includes a wall 34 projecting inwardly of each end of the legs along an angle other than horizontal, horizontal being referenced to FIG. 22, an outwardly extending wall 35, generally parallel to the top 30, and an upwardly extending projection 36. The legs 31 and 32, together with the top 30, define an open mouth chamber 38. The walls 34 and 35 define a groove 37 extending along each longitudinal side of the runners 4, while the wall 34 defines a restriction 39 along the open mouth of the chamber 38. The particular shape of the runner 4 along the lower formation, and in particular, the relationship of the walls 34 with the legs 31, 32 and the walls 35, is important in the various applications of our invention, as will be apparent from the later set forth description.

Figure 6:
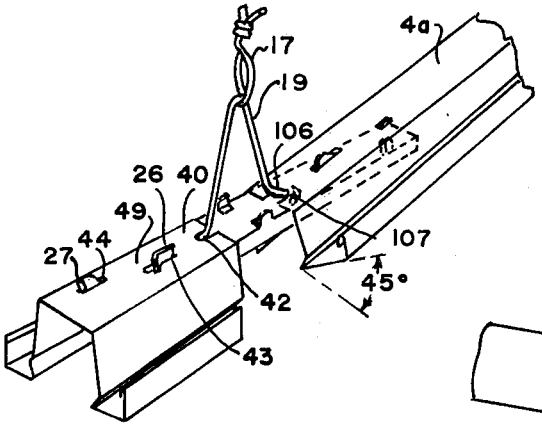
FIG. 6 is a view in perspective, partly broken away, showing the intermounting of two main runners utilized in conjunction with the lighting system of this invention.

In the lighting system of grid system 1, a plurality of runners **4*a* and 4*b* are used to construct desired grid patterns. The runners 4*a* and 4*b* each have the cross sectional shape described above and shown in FIG. 22. However, the runners 4*a* and 4*b* differ in certain other aspects of their constructions. Thus, the runner 4*a* has a pair of ends 40, while the runner 4*b* has a pair of ends 41, best observable in FIGS. 6, 8, 24 and 25. The end 40 of the runner 4*a* has an open mouth slot 42 punched in it which is designed to receive the portion 106 of the hook 28, and to permit the top wall 30 to close at least a portion of the opening 25 in the coupling 20, thereby locking the hanger 19 to the coupling. The end 40 also has a pair of rectangular openings 43 and 44, respectively, formed in it. The openings 43 and 44 are sized to receive the tabs 26 and 27 of the coupling 20. The cut-away edge 29 of the tab 27 means that the openings 43 and 44 may be offset from the center line of the tabs 26 and 27. Consequently, the end 40 of the runner 4*a* must be angled over the tab 26 in order to align the opening 44 with the tab 27. This angular intermounting is illustrated in FIG. 6, and is important in that once positioned, the runner 4*a* and coupling 20 interlock relatively tightly together with little play between the respective parts. If desired, either or both of the tabs 26 and 27 also may be folded to further secure the runner to the coupler 20. Wall 35 of the lower formation 33 is cut away at an angle of approximately 45° along each side of the lower formation, as is best observable in FIG. 6**.

The end 41 of the runner **4*b* has a tab 46 extending outwardly from the top 30, but located within the plane defined by the top 30. The tab 46 has an opening 47 in it. Rather than cutting away a portion of the wall 35 of the lower formation 33 as is done with the runner 4*a*, a portion 45 of the runner 4*b* is formed so as to define a riser 48 and a tab 49. Riser 48 is offset from a plane defined by the wall 35 of the lower formation 33. As shown, the opening 47 of the tab 46 is sized to receive the tab 21 of the coupling 20, while the tab 49 is sized so that it may be carried along the width of the wall 35. Riser 48 allows the end 41 of runner 4*b* to ride over the cut-away portion of the wall 35 of the runner 4*a* so that the interconnection of the runners 4*a* and 4*b* have a mittered appearance to any observer beneath the lighting system 1**.

Figure 19:
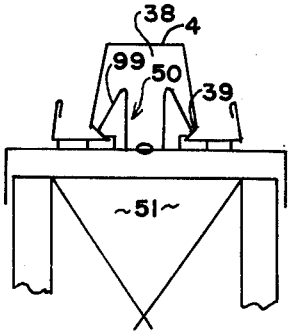
FIG. 19 is a diagrammatic view illustrating the interconnection of a wall partition with the lighting system of this invention.

The general shape of the main runner 4 in either the runner **4*a* or 4*b* end configurations is important in a number of related applicational uses of the lighting system of this invention. Thus, as shown in FIG. 19, the restriction 39 serves as a stop for a latch means 50. The latch means 50 is attached to a partition 51. The latch means 50 is conventional, and may comprise any of a variety of commercially available devices. Preferably, the latch means 50 includes a pair of resiliently mounted arms 99 which are compressed for insertion through the relatively narrow mouth of the chamber 38 of the runner 4, and thereafter expanded automatically by the resiliency of the material used for arm 99 construction, for example, so as to engage the restriction 39**.

Figure 20:
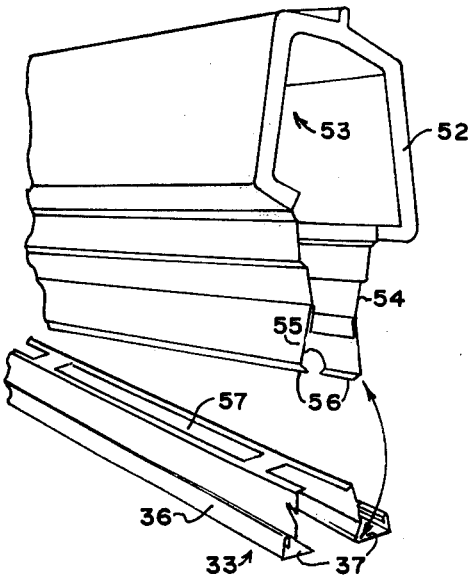
FIG. 20 is a view in perspective, partly broken away, showing the interconnection of an air supply means with the lighting system of this invention.
Figure 21:
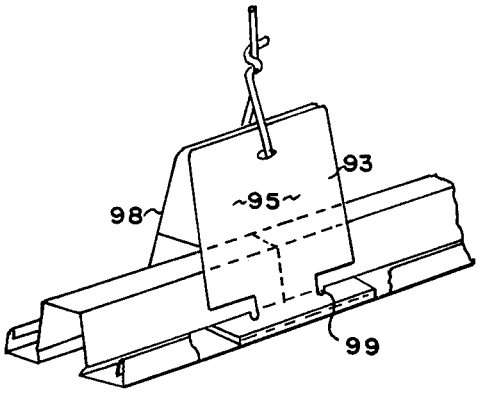
FIG. 21 is a view in perspective, partly broken away, of a second illustrative embodiment of hanger means utilized in conjunction with a lighting system of this invention.

In like manner, the ease of connecting an air boot 52 to the lighting system of our invention is demonstrated in FIG. 20. The air boot 52 includes an air supply duct 53 having a pair of flexible arms 54 and 55 extending downwardly from it. Each of arms 54 and 55 are terminated along an inboardly directed lip 56. The lip 56 is designed to be engagable in the groove 37 of the lower formation 33, thereby permitting attachment of the air boot 52 to the runner 4. The lip 56 is sized so that the projection 36 of the main runner lower formation 33 is able to provide support for the panels 6 or luminaires 7, as later described, even when the air boot 52 is attached to the main runner. When an air supply function is performed by the lighting system of our invention, the top 30 of the runner 4 may have a plurality of openings 57 in it for permitting communication between the boot 52 and the opposite or observer side of the system, through the chamber 38 of the runner 4.

It thus may be observed that a grid pattern for the lighting system 1 is constructed and installed easily as compared to prior art designs. Except for their ends, the runners **4*a* and 4*b*** are alike, which simplifies both manufacturing and inventory problems.

Figure 9:
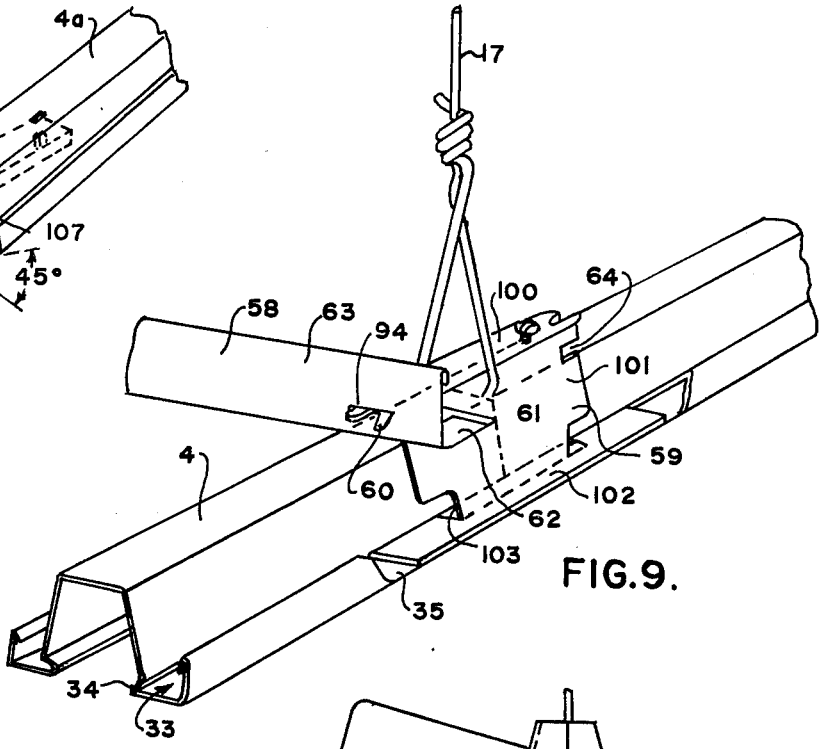
FIG. 9 is a view in perspective of a stabilizer means compatible with the lighting system embodiment of FIG. 2, taken about the area 9—9 of FIG. 2.
Figure 8:
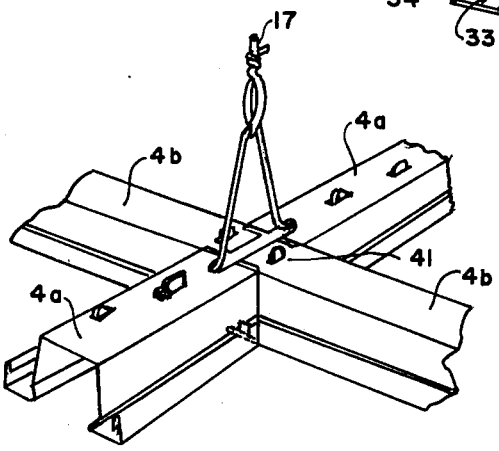
FIG. 8 is a view in perspective, partly broken away, illustrating the completed interconnection of four main runner members for the grid application shown in FIG. 1.
Figure 22A:
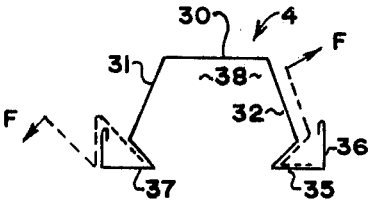
FIG. 22*a* is a diagrammatic end view of the main runner shown in FIG. 22, demonstrating the ease of interlocking additional structure to the main runner provided by the novel runner design.
Figure 24:
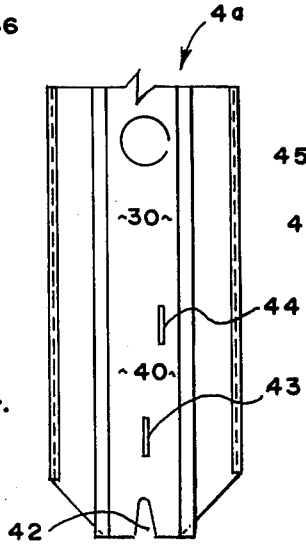
FIG. 24 is a view in perspective, partly broken away, of an end construction for a main runner used in conjunction with the lighting system of this invention.
Figure 25:
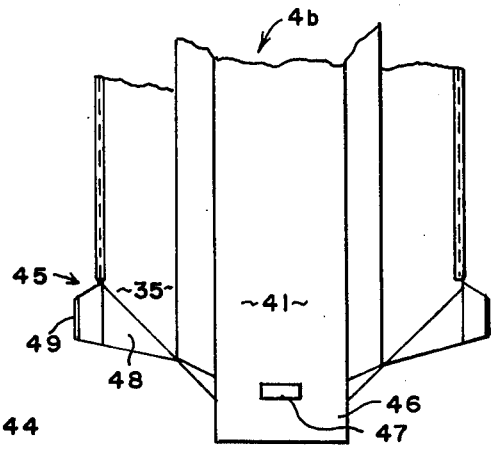
FIG. 25 is a view in perspective, partly broken away, of a second end construction for a main runner used in conjunction with the lighting system of this invention.

The lighting system 2 utilizes the runners **4*a* and the coupling 20 in a manner similar to that described in conjunction with the system 1. In the system 2, however, it often is desirable to provide extra stability to the pattern of main runners 4 through the use of a plurality of cross braces 58. While each of the luminaires 7 also function to stabilize the pattern, applications often arise in which the use of cross braces 58 is desirable. As shown in FIG. 9, a connector 59 is attached to the runner 4 along the lower formation 33. The connector 59 may assume a variety of design shapes, the design shown in the drawings being illustrative of the variation available. The connector 59 preferably is constructed from sheet metal, and has a pair of ears 60 extending outwardly from a body 61. Body 61 includes an upper part 100, a side portion 101, and a base 102 attached to the side portion 101 along a bridge portion 103. The base 102 again is sized for reception in the groove 37 of the runner 4. Base 102 also is sized so as to permit it to rest against the wall 35. As indicated above, the particular shape of the wall 34, wall 35 combination facilitates interconnection of various structural components used in conjunction with the lighting system of our invention. FIG. 22*a* demonstrates visually methods for making suitable interconnection with the runner 4. Two illustrative examples are shown in FIG. 22*a*** and any force acting on a structure indicated within the groove 37 functions to lock the structure to the runner 4. Upper part 100 has a pair of notches 64 formed in it, positioned on opposite sides of the longitudinal length of the connector 59.

The cross brace 58 is L-shaped in cross section, having a first leg 62 and a second leg 63. Each end of the leg 63 has an opening 94 in it, which receives the ears 60 when the cross brace 58 is intermounted between pairs of runners 4. The leg 62 is inserted in the notch 64 of the connector 59 and the ears 60 are deformed, thereby attaching the parts together and ensuring a tight connection. Those skilled in the art will recognize that the luminaire 7 serves the same function as the cross brace 58, and that use of the cross brace is an optional feature often not necessary in applicational use.

Figure 11:
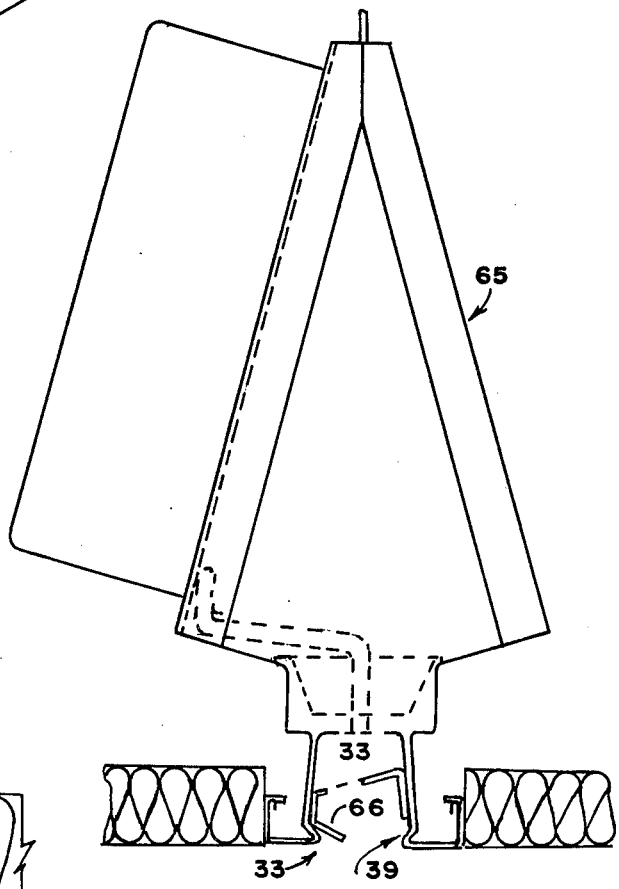
FIG. 11 is a sectional view taken along the line 11—11 of FIG. 2.

FIG. 11 illustrates another air boot 65 design compatible with the main runner 4 in that the lower formation 33 provides an interconnection feature for the air boot 65, similar to that described in conjunction with FIG. 20. FIG. 11 further illustrates the use of an air blade 66 which is held within the chamber 38 by the restriction 39. The particular air blade 66 shown is an elongated structure generally used, by positioning or removal, to obtain either vertical or horizontal air pattern distribution along the ceiling line defined by one of the lighting systems 1, 2 or 3 of this invention, for example. Horizontal and vertical are referenced to FIG. 11.

Figure 3A:
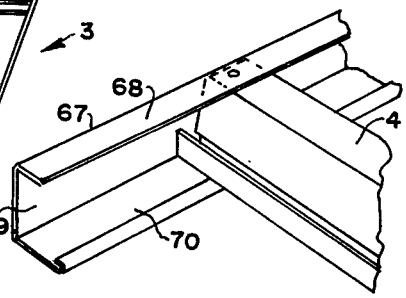
FIG. 3*a* is a view in perspective, partly broken away, taken about the area 3*a* in FIG. 3.

The lighting system 3 also utilizes the main runner 4 for ceiling definition, but requires a wall channel 67 along each side of the walls defining the corridor in which the lighting system 3 finds application. The wall channel 67, shown in FIG. 3*a*, is a U-shaped bracket having a top wall 68, a side wall 69 and a bottom wall 70. The distance between the top wall 68 and the bottom wall 70 is predetermined so that an end of the main runner 4 may be inserted between the walls in a friction fit. The main runner 4 is attached to the wall channel 67 by any convenient method. Conventional fasteners work well, for example. Spacing between either the grids of FIG. 1 or the parallel runners 4 of FIGS. 2 and 3 may vary, although as indicated, 5 feet tie points 5 are preferred.

Figure 4:
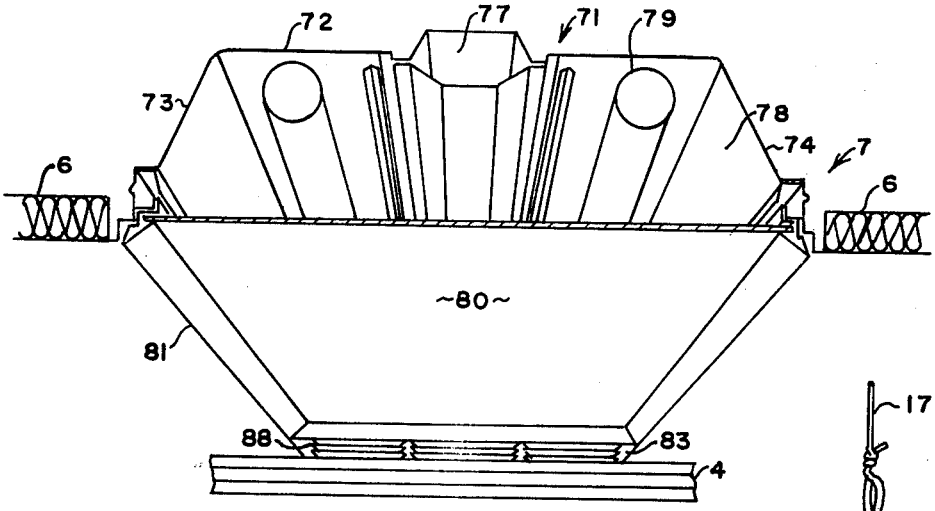
FIG. 4 is a view in perspective, partly broken away, taken along the line 4—4 of FIG. 2.

One illustrative type of lay in fixture compatible with our invention is shown in FIG. 4. While a number of luminaire structures may be used with the lighting system disclosed, the particular luminaire shown in FIGS. 1, 2 and 4 has a number of advantages not found in prior art designs.

Figure 12:
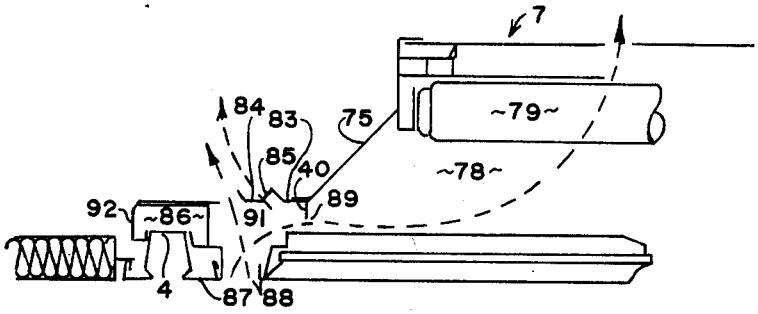
FIG. 12 is a sectional view taken along the line 12—12 of FIG. 1.
Figure 13:
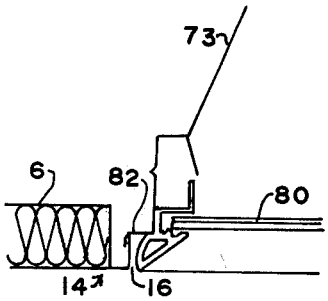
FIG. 13 is a sectional view taken along the line 13—13 of FIG. 1.

The preferred luminaire 7 design includes a housing 71 having a top 72, a first pair of oppositely opposed, sloping side walls 73 and 74, respectively, and a pair of sloping end walls 75 and 76, respectively. The luminaire 7 is best described with reference to FIGS. 4, 12, 13 and 14. As shown in FIG. 4, the wall 72 has a raceway 77 formed in it. The raceway 77 is a conventional means and method for carrying the electrical circuit components required for actual operation of the luminaire 7. The top wall 72 and various side walls of the housing 71 define a lamp cavity 78. The cavity 78 carries conventional fluorescent light tubes 79, for example. The cavity 78 is closed by a panel 80 which may be any of a variety of prismatic lens panels or the like well known in the art. The panel 80 is movably mounted to the housing 71 by any convenient method, and it is designed so that a lip 81 will be flush fitting with adjacent ceiling panels 6 in the normal, closed position of the panel 80. As best shown in FIG. 13, both of the sides 73 and 74 of the luminaire or fixture 7, terms used synonomously in this specification, have an outwardly extending flange 82 which rests on the leg 16 of the structure 14 of adjacent ceiling panel 6. It will be apparent to those skilled in the art that the ceiling panel 6*b*, which is constructed with the tab 13, may be used to replace the fixture 7 where appropriate, in the various ceiling patterns possible with the lighting system shown.

Figure 14:
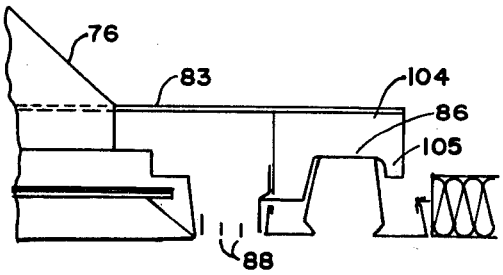
FIG. 14 is a sectional view taken along the line 14—14 of FIG. 1.

The ends 75 and 76 of the housing 71 have an extension 83 either integrally formed with or manufactured separately and attached to them by any convenient method. The extensions 83 and sides 73, 74 define the overall longitudinal length of the luminaire 7. As shown in FIGS. 12 and 14, the extension 83 includes a wall 84 having a plurality of louvers 85 formed in it. The extension 83 also has a tab 92 positioned at each of the four corners of the generally rectangular housing 71. The tab 92 is adapted to receive the runner 4 in a friction fit and permit the luminaire 7 to be dropped onto the system of runners 4 in any particular application. A bottom 87 of the end piece 83 has a plurality of louvers 88 formed in it which communicate with the louvers 85 along an air passage 91 defined by the end piece 83. The wall 75 of the luminaire 7 may have an opening 89 in it, for permitting communication between the lamp cavity 78 and air passage 91, if desired. The amount of air passing through the lamp cavity 78 and passing directly through the end piece 83 may be varied, FIG. 14 illustrating a situation where air return through the end piece 83 is eliminated.

Figure 23:
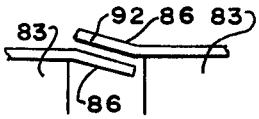
FIG. 23 is an enlarged top plan view, partly broken away, of a luminaire end panel used in conjunction with the lighting system shown in FIG. 1.

As indicated, the tabs 92 project from the end piece 83. Each of the tabs 92 has a first arm 104 extending outwardly from the extension 83, and a second arm 105 positioned so as to define a receptacle 86. The receptacle 86 is sized to receive the wall 30 of the runner 4, thereby mounting the fixture between runners. The tabs 92 are offset from the longitudinal axis of the luminaire 7 a predetermined amount. That amount, diagrammatically illustrated in FIG. 23, permits a plurality of the luminaires 7 to be aligned longitudinally, if desired, for a particular application. Restated, each of the luminaires 7 has four tabs 92 at the respective corners of the generally rectangular silhouette of the fixture. The tabs 92 are all offset in the same direction from a longitudinal center line axis through the fixture. Respective pairs of the tabs 92 on opposite ends of a diagonal through the rectangular silhouette of the fixture may be envisioned as being 180° out of phase, but each tab lies in the same parallel plane with the tab 92 at the opposite end of the diagonal. Consequently, fixtures may be abutted to one another across a single main runner 4, as diagrammatically illustrated in FIG. 23.

Figure 18:
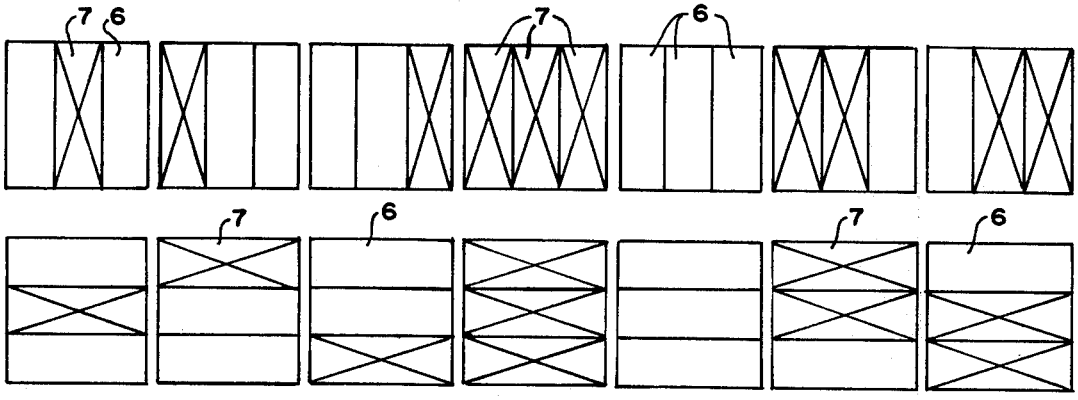
FIG. 18 is a diagrammatic view illustrating the various light and panel configurations available for the grid system shown in FIG. 1.

The width of the fixture 7 and the panels 6 are chosen so that three panels complete a grid of the lighting system 1. Because of the interchangeability of the panels and luminaires, heretofore impossible lighting system design techniques are easy to accomplish with our invention. FIG. 18 diagrammatically illustrates the placement of the luminaire 7 and associated panels 6. As is observable in FIG. 18, a variety of luminaire 7 and panel 6 combinations are possible with our light system construction.

Figure 15:
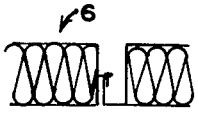
FIG. 15 is a sectional view taken along the line 15—15 of FIG. 1.
Figure 16:
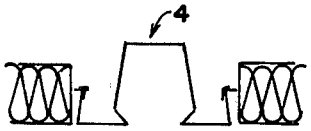
FIG. 16 is a sectional view taken along the line 16—16 of FIG. 1.
Figure 17:
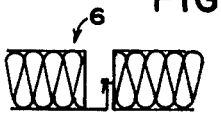
FIG. 17 is a sectional view taken along the line 17—17 of FIG. 1.

FIGS. 15, 16 and 17 illustrate how the panels 6 are supported by the main runners 4, and the relationship of the panels with one another for the lighting system shown in FIG. 1.

Numerous variations, within the scope of the appended claims, will be apparent to those skilled in the art in light of the foregoing description and accompanying drawings. Thus, the general silhouette of the luminaire 7 may be varied in other embodiments of this invention. Likewise, the design or construction of the panels 6 may vary. Acoustical properties of the panel 6 form no part of this invention, and the construction or the material composing the panels may vary. As indicated, the ends of the main runners 4 may vary, depending upon the method used for connecting the runners to wall structures or to one another. While a wire bail hanger 19 was described as the preferred method for hanging the main runner 4, the design of the main runner 4 facilitates the use of other hangers, where desired. Thus, for example, a pair of identical hangers 93 and 98 may be used in place of the hanger 19. The hanger 93 includes a broad support area 95 which narrows along a rib 96 and expands into a flange 97 which is inserted in the lower formation 33 of the main runner 4 and engaged by the groove 37. Groove 37 engagement automatically couples the hanger to the main runner 4. Thereafter, the main runner is suspended in a conventional manner. The main runner 4 also may hve a number of openings in one or more of the walls forming the structure of the runner, depending upon additional applications or accessories used in conjunction with the main runner 4. These variations are merely illustrative.

Having thus described the invention, what is claimed and desired to be secured by Letters Patent is:

1. A lighting system comprising:

a first main runner member;

a second main runner member, said first and said second main runner members being identical in at least one cross section, said cross section generally having an inverted U-shape, said inverted U-shape defining an open mouth chamber, said U-shape having a connecting portion, a first leg attached to said connecting portion, a second leg attached to said connecting portion, said legs having a second end and a lip, said lip having a first part extending inboard of the second end of said legs at an angle such that said first part lies in a plane other than a horizontal plane, a second part approximately parallel to said connecting portion, and an upturned third part, the relationship of the first part, the second part and the third part of said lip permitting the attachment of additional structure to said runners both along the lip and along the chamber defined by said inverted U-shape;

a luminaire mounted between said first and second runners; and ceiling panel means extending between said first and said second runner members adjacent at least one side of said luminaire.

2. The system of claim 1 further characterized by coupling means for interconnecting successive ones of said first and said second main runner members, said coupling means having a first surface sized for reception in the chamber defined by said inverted U-shape, and a plurality of tabs formed in said first surface, at least one of said tabs having a cut-away edge, said second main runner member having a plurality of openings in said connecting portion for receiving said tabs, said tabs and openings having respective centerline axes, the axes of at least one of said tabs and one of said openings being disaligned, the cut-away edge of said tab permitting the interconnection of successive ones of said second main runner members.

3. The system of claim 2 further characterized by a pair of openings in said coupling adapted to receive a hanger means, hanger means associated with said coupling, said hanger means having a first end and a second end insertable in said coupling opening pair, each of the interconnecting ends of said second main runner member having a slot in it for receiving said hanger means, and a wall part defining the interconnecting ends of said second main runner, said wall part partially closing individual ones of said opening pair in the interconnected position of said coupling and said second main runner member.

4. The system of claim 3 wherein said luminaire has first and second ends and a longitudinal axis, each of said luminaire ends having a pair of tabs offset with respect to the longitudinal axis of said fixture, each of said tabs being approximately parallel to one another, the offset but parallel tabs of a first luminaire being adapted for placement adjacent to the offset but parallel tabs of a second luminaire when said luminaires are arranged longitudinally in said system.

5. The system of claim 4 wherein the first and second legs of said runner are a first color, and the second part of said lip is a second color, the first part of said lip having the boundary line between said first and said second colors extending along it.

6. The system of claim 5 further characterized by clip means insertable in the open mouth of said runner, and partition means mounted to said clip means, said partition means adapted to divide a volume in some predetermined manner.

7. The system of claim 1 wherein said first part of said lip and each of said legs define a groove, said groove adapted to receive a utility hanger, a utility hanger mounted to said runner, said utility hanger including a flange insertable in said groove, and a support area attached to said flange and adapted to abut said second part of said lip.

8. A lighting system comprising:

at least first and second main runner members arranged parallel-wise and adapted to define a plane above a floor area of a building, each of said runners having an inverted U-shape in cross section, said U-shape including a connecting portion delimiting an upper surface of said runners, a first leg attached to said connecting part along a first end of said leg, a second leg attached to said connecting part along a first end of said second leg, said U-shape defining an open mouth channel observable from said floor, each of said first and said second legs having a lip attached to them along a second end of said legs, said lip including a first part extending inwardly of said channel so as to partially close the mouth of said channel, a second part connected to said first part and extending outwardly and spaced from said first part, and a third part extending upwardly from and attached to said second part, the relationship of the first, second and third parts of said lip permitting the attachment of additional structure to said runners both along the lip and along the chamber defined by said inverted U-shape;

a luminaire adapted for mounting between said first and said second runners; and means for attaching said first and second runners to said building.

9. The lighting system of claim 8 wherein said attaching means comprises a first hanger and a second hanger, each of said hangers having a flange insertable in said lip so as to abut said second part, a rib portion attached to said flange, and a support area attached to said rib portion for attaching said hanger to a drop wire.

10. The lighting system of claim 8 wherein said attaching means includes a coupling means having a first surface sized for reception in the chamber defined by said inverted U-shape, and a plurality of tabs formed in said first surface, said second main runner member having a plurality of openings in said connecting portion for receiving said tabs.

11. The lighting system of claim 10 wherein at least one of said tabs has a cut away edge, said tabs and said openings having respective first and second centerline axes, the axes of at least one of said tabs and one of said openings being disaligned, said cut away edge of said tabs permitting the interconnection of successive ones of said second main runner members.

12. The lighting system of claim 10 wherein the first and second legs of said runner are a first color, and the second part of said lip is a second color, the first part of said lip having the boundary line between said first and said second colors extending along it.

13. The lighting system of claim 12 further characterized by clip means insertable in the open mouth of said runner, and partition means mounted to said clip means, said partition means adapted to divide a volume in some predetermined manner.

14. A lighting system, comprising:

a plurality of runners arranged in a predetermined manner, said runner plurality including a first member having a first end termination, and a second member having a second end termination, each of said runner plurality having an inverted U-shape including a connecting portion delimiting an upper surface for said runners, a first leg attached to said connecting portion, and a second leg attached to said connecting portion, said U-shape defining an open mouth chamber, the runners having said first end termination including a slot formed in said connecting portion, the runners having said second end termination including a tab extending outwardly from said connecting part, said tab having an opening in it, the connecting portions of the runners having said first end termination further having a pair of openings in them;

coupling means for interconnecting said runners, said coupling means including an elongated structure having a top wall, said coupling means having a first surface sized for reception in the chamber defined by said inverted U-shape, a plurality of first tabs formed in said first surface, at least one of said first tabs having a cut-away edge, and a pair of second tabs positioned approximately at the mid-point of said coupling means, said coupling means adapted to interconnect a pair of said main runners having said first end termination along the first tab plurality and a second pair of said runners having a second end termination along the second tab pair positioned approximately at the mid-point of said coupling means.

15. The lighting system of claim 14 wherein each runner of said runner plurality has an inverted U-shape in cross section, said U-shape including a connecting portion delimiting an upper surface of said runners, a first leg attached to said connecting portion along a first end of said leg, a second leg attached to said connecting portion along a first end second leg, said U-shape defining an open mouth channel, each of said first and said second legs having a lip attached along a second end of said legs, said lip including a first part extending inwardly of said channel such that said first part exists in a plane other than a horizontal plane, a second part connected to said first part and extending outwardly from said first part, and a third part extending upwardly from and attached to said second part.

16. The lighting system of claim 15 further characterized by at least one luminaire mounted to said runner plurality, and a plurality of ceiling panel means mounted with said luminaire and said runner plurality, the effective length and width dimensions of said luminaire and said ceiling panel means being equal.

17. The system of claim 16 wherein said first and second legs of said runner are a first color, and the second part of said lip is a second color, the first part of said lip having the boundary line between said first and said second colors extending along it.

18. The system of claim 17 further characterized by clip means insertable in the open mouth of said runner, and partition means mounted to said clip means, said partition means adapted to divide a volume in some predetermined manner.

19. A lighting system comprising:

a first main runner member;

a second main runner member spaced from said first main runner member, said first and said second main runner members having a similar shape in cross section, said shape including a first leg, a second leg, and a connecting portion between said first and second legs along a first end of said legs, each of said legs having a lip attached to a second end thereof, said lip having a first part extending inboard of the second end of said legs at an angle such that said first part lies in a plane other than a horizontal plane, a second part approximately parallel to said connecting portion, and an upturned third portion; and a luminaire mounted between said first and said second main runner members, said luminaire including a housing, said housing defining a lamp cavity, end panels along two opposed ends of said housing, said luminaire having a longitudinal axis, a plurality of tabs mounted to said housing, said tabs being parallel to one another but offset from said longitudinal axis, each of said tabs including a first leg and a second leg, said legs being arranged to define a receptacle, said receptacle being sized to receive respective ones of said first and said second main runner members.

20. The lighting system of claim 19 further characterized by ceiling panel means mounted between said first and said second main runner members, the length and width dimensions of said ceiling panel means and the length and width dimension of said luminaire being equal.

* * * * *